US007077503B2

(12) United States Patent
Kaneko et al.

(10) Patent No.: US 7,077,503 B2
(45) Date of Patent: Jul. 18, 2006

(54) INK JET HEAD

(75) Inventors: Mineo Kaneko, Tokyo (JP); Ken Tsuchii, Kanagawa (JP); Keiichiro Tsukuda, Kanagawa (JP); Masaki Oikawa, Tokyo (JP); Kenji Yabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 10/420,920

(22) Filed: Apr. 23, 2003

(65) Prior Publication Data

US 2003/0214552 A1 Nov. 20, 2003

(30) Foreign Application Priority Data

Apr. 23, 2002 (JP) ..... 2002-121202
Apr. 18, 2003 (JP) ..... 2003-114515

(51) Int. Cl.
*B41J 2/14* (2006.01)

(52) U.S. Cl. ..... 347/48; 347/20; 347/63

(58) Field of Classification Search ..... 347/48, 347/44, 54, 56, 47, 61, 77, 62, 45, 50, 75, 347/15, 20, 63, 68
See application file for complete search history.

(56) References Cited

U.S. PATENT DOCUMENTS 5,072,242 A * 12/1991 Onhisi et al. ..... 347/54
5,172,139 A * 12/1992 Sekiya et al. ..... 347/48
5,880,762 A * 3/1999 Ishinaga et al. ..... 347/48
6,139,761 A 10/2000 Ohkuma
6,174,049 B1 1/2001 Tachihara et al.
6,186,616 B1 2/2001 Inoue et al.
6,224,191 B1 5/2001 Saito et al.
6,305,080 B1 10/2001 Komuro et al.
6,354,698 B1 3/2002 Tachihara et al.
6,412,920 B1 7/2002 Matsumoto et al.
6,474,790 B1 11/2002 Kaneko
6,527,367 B1 3/2003 Yabe
6,575,560 B1 6/2003 Kaneko et al.
6,582,060 B1 * 6/2003 Kitakami et al. ..... 347/56
6,726,308 B1 * 4/2004 Lee et al. ..... 347/48
6,729,715 B1 * 5/2004 Gonzalez ..... 347/63
2002/0008729 A1 1/2002 Kaneko et al.
2002/0048477 A1 4/2002 Udagawa et al.
2002/0063756 A1 5/2002 Tsuchii et al
2002/0089567 A1 7/2002 Sato et al.
2002/0122101 A1 9/2002 Yabe
2003/0048328 A1 3/2003 Inamoto et al.

FOREIGN PATENT DOCUMENTS

JP 62-264957 11/1987

(Continued)

*Primary Examiner*—Manish S. Shah
(74) *Attorney, Agent, or Firm*—Fitzpatrick, Cella, Harper & Scinto

(57) ABSTRACT

An ink jet head according to the present invention includes multiple discharge ports for discharging ink, multiple ink flow paths for communicating with the discharge ports, and heat generating elements for generating bubbles in ink filling the ink flow paths. For each ink flow path, two heat generating elements are arranged therein, and the discharge port is arranged along a line that is extended, from the center of a pressure generation region formed by the two heat generating elements, in the normal direction relative to the surface of the substrate. The arrangement pitch of the heat generating elements is equal to or greater than 600 dpi, and the interval dhn between a partition wall defining an ink flow path and the heat generating element adjacent to the partition wall is equal to or smaller than 4 μm.

16 Claims, 9 Drawing Sheets

FOREIGN PATENT DOCUMENTS

| | | | |
|---|---|---|---|
| JP | 08-039802 | * | 2/1996 |
| JP | 9-11479 | | 1/1997 |
| JP | 11-188870 | | 7/1999 |

* cited by examiner

INK JET HEAD

BACKGROUND OF THE INVENTION

1. Field of the Invention

The present invention relates to an ink jet head that performs recording by discharging ink onto a recording medium.

2. Related Background Art

Because producing high quality characters and images is easy with ink jet recording apparatuses, such output devices are widely employed today, especially for computers. Above all, bubble jet systems, wherein ink is forcefully discharged from nozzles by utilizing extremely powerful pressure changes produced by the instantaneous boiling of ink in the nozzles, have become the leading, preferred ink jet recording apparatuses.

Further, as the popularity of ink jet recording apparatuses has grown, so too has the number of requests for improved performance, especially as it pertains to image quality and recording speeds. And since to improve image quality, the diameters of dots formed on a recording medium (specifically, on a recording sheet) are especially important, greater emphasis is placed on the provision of smaller dot diameters for the recording of images, such as photographs, than for the recording of characters. For example, to produce clear, eye-pleasing, or small, characters when recording documents, resolutions ranging from 600 to 1200 dots per inch (dpi) are required, and to provide satisfactory dot diameters, droplets of 80 to 90 μm (about 30 pl, as volume) must be discharged.

On the other hand, for image recording, a resolution of 1200 to 2400 dpi is required to provide smooth tones equivalent to those in a silver halide photograph. Thus, for recording processes performed at these resolutions, when the dot diameter of a droplet to be discharged is 40 μm (about 4 pl, as volume), it is required that two types of ink, having dye densities that differ and ratios of about 1/4 to 1/6, be separately employed, depending on the image density. Whereas when the dot diameter of a droplet to be discharged is reduced to 20 μm (about 0.5 pl, as volume), only one type of ink having a single density need be employed to obtain both the acceptable density for a high density portion and the desirable smoothness for a low density portion. As is described above, reducing the sizes of the droplets that are discharged is required in order to secure the same image quality as that provided by a silver halide photograph.

However, when the sizes of the discharged droplets are reduced, an increased number of dots is required to form an image. For example, to fill an area of 8 inches (about 20 cm)×11 inches (about 28 cm), which is substantially the same size as A4 stock, 130 million 4 pl dots would suffice, while for the same area 250 million 2 pl dots, 500 million 1 pl dots or 1 billion 0.5 dots would be required.

Further, to maintain recording speed while the sizes of the droplets that are discharged are reduced, a corresponding increase in the discharge frequency is required. In this instance, to increase the discharge frequency, an ink volume equivalent to that discharged as droplets from the nozzles of a recording head must be rapidly supplemented from a source upstream of the nozzles, and to implement this, a low nozzle flow resistance is needed (i.e., in cross section, a large flow path is required).

FIGS. 9A and 9B are a plan view and a cross-sectional view for explaining the positional relationship of an ink flow path, a heat generating element and a discharge port in a conventional ink jet head for discharging small droplets.

The conventional ink jet head comprises: a substrate 1001, on the surface of which multiple heat generating elements 1004 are mounted for boiling ink and generating bubbles; and a flow path formation member 1003, for forming, with the substrate 1001, ink flow paths 1002 corresponding to the heat generating elements 1004. The flow path formation member 1003 includes partition walls 1003*a* for defining the ink flow paths 1002, and a ceiling wall 1003*b*, provided on the partition walls 1003*a* parallel to the substrate 1001. Discharge ports 1005 are formed in the ceiling wall 1003*b*, centrally arranged above the individual heat generating elements 1004, so that ink is discharged by the pressure exerted when the heat generating elements 1004 produce bubbles. In order to reduce the size of a droplet to be discharged, it is preferable that the size of the heat generating element 1004 be reduced in proportion to the volume of the droplet, while taking the improved energy efficiency into account. Generally, the size of a bubbling chamber is reduced in accordance with the size of the heat generating element. However, when the heat generating elements are arranged at pitches of 600 dpi or higher, for example, and when, in the conventional manner, the bubbling chamber is reduced in accordance with the capabilities of the heat generating element, the flow resistance in the nozzles will become too high and a desired discharge frequency will not be obtained. Therefore, when the size reduction ratio of the bubbling chamber to the heat generating element is set so it is smaller than the conventional ratio, i.e., relative to the heat generating element, the size of the bubbling chamber is larger than the conventional one, the size of the flow path can be increased in cross section, and the desired discharge frequency can be obtained. Actually, since the discharge characteristic may be changed greatly by changing the height of the flow path, mainly the width of the ink flow path 1002 is increased to obtain the desired discharge frequency.

However, when, as is shown in FIG. 9B, compared with the size of the heat generating element 1004 the width of the flow path 1002 is satisfactorily large, a greater stagnated ink portion is generated near the corners formed by the partition walls 1003*a* and the ceiling wall 1003 that define the ink flow path 1002. And in the stagnated ink portion, residual bubbles, retained in the ink, absorb discharge pressure exerted during the bubbling process and prevent a preferable ink discharge operation from being performed.

SUMMARY OF THE INVENTION

It is, therefore, one objective of the present invention to provide an ink jet head that can efficiently and stably discharge ink droplets through discharge ports, without causing stagnation in ink flow paths.

To achieve this objective, an ink jet head according to the present invention comprises:

a substrate, on the surface of which are mounted, as an array, multiple heat generating elements for generating bubbles in ink;

multiple discharge ports, provided opposite the surface of the substrate, for discharging the ink;

multiple ink flow paths, which respectively communicate with the discharge ports, for supplying the ink; and multiple partition walls for defining the ink flow paths, wherein the ink is discharged from the discharge ports under pressure produced by generating the bubbles, wherein at least one of the heat generating elements is provided in each of the ink flow paths, and the discharge ports are arranged along a line extending outward, in the normal direction, from the center of a pressure generation region, formed by the heat generating elements, to the surface of the substrate, and wherein the pitch employed for the heat generating element arrangement is equal to or greater than 600 dpi, and in the direction in which the heat generating elements are arranged, an interval dhn, between each of the partition walls and the heat generating elements adjacent to the partition walls, is equal to or smaller than 4 μm.

According to the ink jet head of the present invention, since multiple heat generating elements are arranged in each ink flow path, and the interval dhn between the partition wall and the adjacent heat generating element is equal to or smaller than 4 μm, the size of the stagnated ink portion in the ink flow path can be reduced. Therefore, it is possible to prevent both the retention of residual bubbles in the stagnated ink portion and the destabilization of the ink discharge operation.

Further, when the ratio of a distance H, from the surface of the substrate to the ceiling, relative to a thickness t of the partition walls, is set so it is from 1 to 1.5, the strength of the partition walls is ensured, and the cross-sectional size of the ink flow path can be optimized. Thus, since the filling with ink of the ink flow path can be appropriately performed, the ink discharge response frequency can be increased.

In addition, when the heat generating elements are electrically connected in series, by wiring, a higher resistance can be obtained compared with when only one heat generating element of the same size is provided, and the required current can be reduced. Therefore, even when the discharge operating speed is to be increased in accordance with a reduction in the size of a droplet to be discharged, an increase in the current flowing across the heat generating element can be suppressed. Moreover, not only is it possible to prevent heat generation and a voltage drop due to the resistance at the wiring portion extending to the heat generating element, it is also possible to prevent induction noise caused by the transmission of a large current through the wiring portion.

Furthermore, since the width of the ink flow path between the partition walls is constant across the entire area in the direction in which the ink is fed along the ink flow path toward the heat generating element, a cross-sectional area of the ink flow path can be optimized for the entire area through which the ink flows. Therefore, while continuing to provide the effects whereby the stagnated ink portion is reduced and stabilization of the discharge is improved, the frequency of the ink discharge response can be increased.

DETAILED DESCRIPTION OF THE PREFERRED EMBODIMENTS

The preferred embodiments of the present invention will now be described while referring to the accompanying drawings.

First Embodiment

Figure 1A:
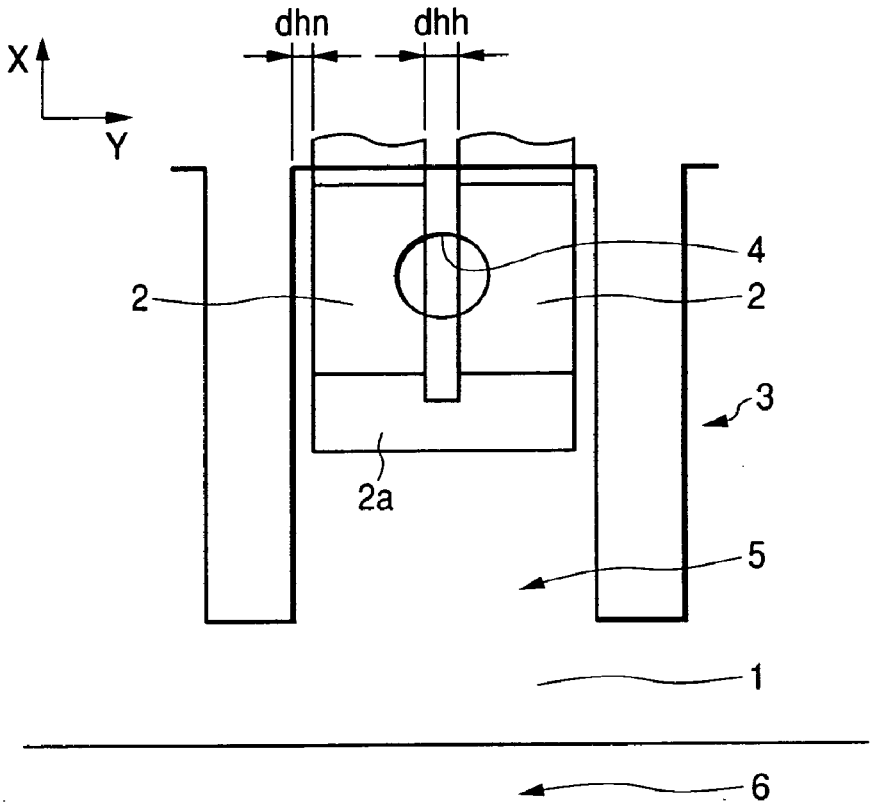
FIGS. 1A and 1B are a perspective plan view and a cross-sectional view for explaining the positional relationship of an ink flow path, heat generating elements and a discharge port for an ink jet head according to a first embodiment of the present invention.
Figure 1B:
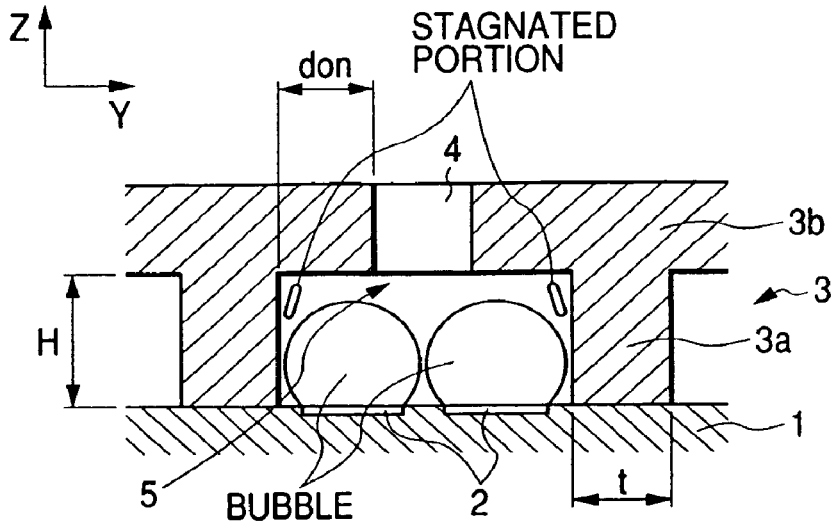

FIGS. 1A and 1B are a perspective view and a cross-sectional view for explaining the positional relationship of an ink flow path, heat generating elements, and a discharge port for an ink jet head according to a first embodiment of the present invention.

The ink jet head of the embodiment comprises: a substrate 1, on the surface of which multiple heat generating elements 2 are provided; and a flow path formation member 3, formed on the substrate 1. The flow path formation member 3 is composed of a photosensitive epoxy resin, for example, and includes partition walls 3*a*, which are used to define heat generating element sets of two elements each, and a ceiling 3*b* opposite the substrate 1. The partition walls 3*a* also define multiple ink flow paths 5, along each of which ink is supplied to two heat generating elements 2. Further, for each of the ink flow paths 5, a discharge port 4 is formed in the ceiling 3*b* along a line that extends, in the normal direction, from the center of a pressure generation region, formed by two heat generating elements 2, to the surface of the substrate 1. The ink flow paths 5 communicate in common with an ink supply path 6, so that ink is fed to the ink supply path 6 from ink supply means (not shown), such as an ink tank, and is transmitted along the ink supply path 6 to the ink flow paths 5.

As is described above, in this embodiment, two heat generating elements 2 are arranged along one ink flow path 5 having a discharge port 4, and are electrically connected, in series, by a U-shaped line 2*a*.

Table 1 shows the results obtained by examining several response frequency and discharge stability samples wherein the sizes of the individual sections of the thus arranged ink jet head for this embodiment were changed.

TABLE 1

| | Head Size | | | | | | | | | | | | | | |
|---|---|---|---|---|---|---|---|---|---|---|---|---|---|---|---|
| | Heat Generating Element | | | | | | Ink Flow Path | | | | | | | Evaluation Results | |
| Sample | Length l μm | Width W μm | Dimension S μm² | Resistance Ratio | dhh μm | dhn μm | Pitch μm | Flow Path Width μm | Flow Path Height μm | Partition Wall Height/Width Ratio | Discharge Port μm | don/H | Vd pl | f kHz | Discharge Stability |
| 1a | 23 | 23 | 529 | 1.0 | 0 | 2 | 42 | 27 | 13 | 0.9 | 10.5 | 0.64 | 2.5 | 43 | — |
| 1b | 24 | 11 | 528 | 4.4 | 3 | 2 | 42 | 29 | 13 | 1.0 | 10.5 | 0.71 | 2.5 | 50 | A |
| 1c | 22 | 13 | 550 | 3.5 | 3 | 2 | 42 | 32 | 13 | 1.3 | 10.5 | 0.83 | 2.5 | 55 | A |
| 1d | 24 | 11 | 528 | 4.4 | 6 | 2 | 42 | 32 | 13 | 1.3 | 10.5 | 0.83 | 2.5 | 55 | B |
| 1e | 28 | 9 | 504 | 6.2 | 2 | 2 | 42 | 24 | 13 | 0.7 | 10.5 | 0.52 | 2.5 | 38 | A |
| 1f | 26 | 10 | 520 | 5.2 | 2 | 5 | 42 | 32 | 13 | 1.3 | 10.5 | 0.83 | 2.5 | 55 | C |
| 1g | 28 | 13 | 700 | 4.5 | 3 | 2 | 42 | 32 | 15 | 1.5 | 16 | 0.53 | 5 | 35 | A |
| 1h | 10 | 13 | 250 | 1.6 | 3 | 2 | 42 | 32 | 10 | 1.0 | 8 | 1.2 | 1 | 75 | A |
| 1i | 18 | 7 | 252 | 5.1 | 3 | 2 | 28 | 21 | 10 | 1.4 | 8 | 0.65 | 1 | 35 | A |

In Tables 1 to 4, A shows that the discharge stability is equal to or more excellent than the sample 1a, B shows that the discharge stability is not excellent, but good, and C shows that the discharge stability is bad.

Figure 9A:
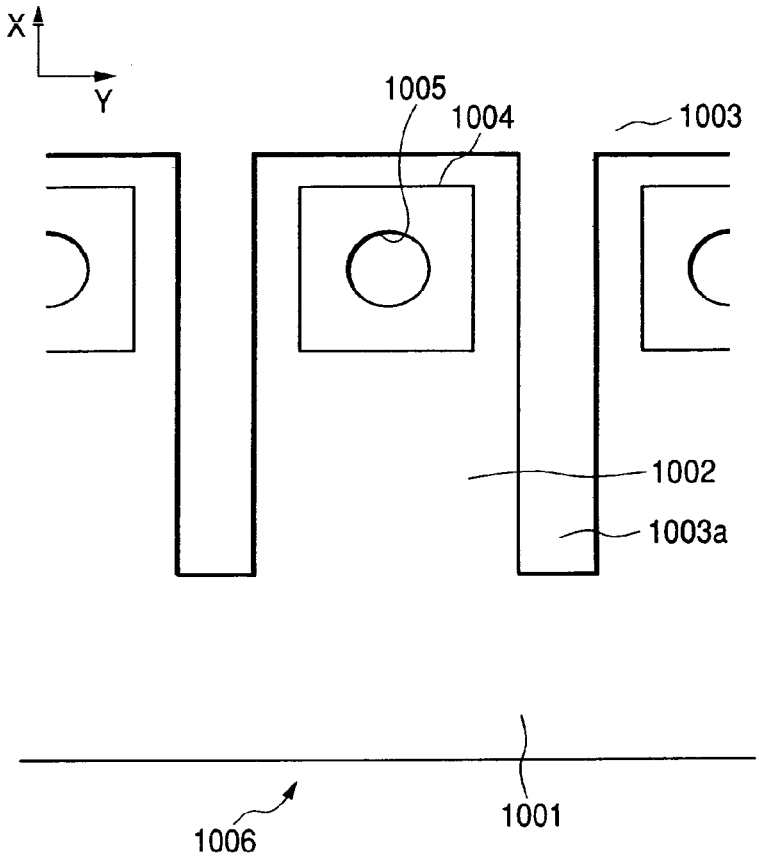
FIGS. 9A and 9B are a plan view and a cross-sectional view for explaining the positional relationship of ink flow paths, heat generating elements and discharge ports of a conventional ink jet head.
Figure 9B:
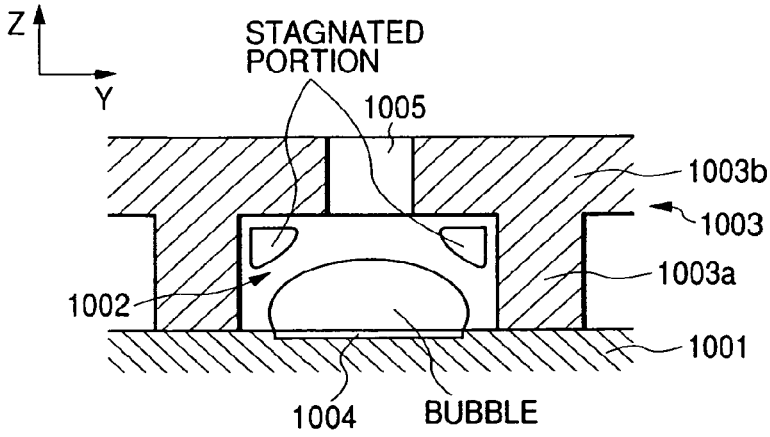

According to the first embodiment, of the samples 1a to 1i in Table 1, samples 1b to 1i are related to the ink jet head in FIGS. 1A and 1B while sample 1a is related to the conventional ink jet head in FIGS. 9A and 9B. Therefore, sample 1a employs a configuration wherein one comparatively large heat generating element is provided along each ink flow path, and samples 1b and 1i employ a configuration wherein two comparatively small heat generating elements are electrically connected, in series, along each ink flow path. It should be noted that for this embodiment, sample 1a is shown in Table 1 as a comparison reference for samples 1b to 1i.

First, samples 1a to 1f will be explained. As for the sizes used in common for these samples, 42 μm (600 dpi) is employed as the pitch both for the ink flow paths, the discharge port and the heat generating elements (or a group of heat generating elements). The group of heat generating elements means a set of a plurality of heat generating elements provided in each ink flow path. In addition, 10.5 μm is set as the opening diameter for each discharge port, 13 μm is set as the height of the ink flow path, and 2.5 pl is set as the volume of one droplet to be discharged.

On the contrary, the following sizes are variously changed: the length l, the width w and the resistance ratio of the heat generating element; the interval dhh between the heat generating elements arranged along each ink flow path; the interval dhn between each heat generating element and a partition wall; the width of the ink flow path; the ratio of the height of a partition wall to the thickness t of the partition wall (partition wall height/width ratio); and the ratio (don/H) of the distance don, between a partition wall and the edge of a discharge port, relative to the height of the partition wall. It should be noted that the length l and the width w of a heat generating element are set so that, overall, the dimension S of the heat generating element is substantially the same for all the samples.

The width of the ink flow path is set at a maximum of 32 μm, so that the appropriate partition wall thickness t can be obtained and a satisfactory strength ensured. When the width of the ink flow path is 32 μm, the partition wall thickness is 10 μm because, as is described above, the pitch for an ink flow path is 42 μm. Since in this case, as is described above, the height of a partition wall is 13 μm, the partition wall height/width ratio is 1.3. Generally, the strength of a partition wall begins to be reduced when the partition wall height/width ratio exceeds 1, while the strength drops drastically when the ratio exceeds 1.5. Therefore, for the samples in Table 1, the width of an ink flow path is so determined that the range of the partition wall height/width ratio does not exceed 1.5. It should be noted that when the width of the ink flow path is set so it is greater than 32 μm, the partition walls are deformed during the process performed to manufacture a recording head, and that such samples were not included in those that were evaluated.

For samples 1a to 1f, ink was actually discharged to evaluate the response frequency and the discharge stability. As is apparent from the evaluation results in Table 1, all the samples 1b to 1f related to the first embodiment provided a better response frequency than the sample 1a, which is the conventional example. For the discharge stability evaluation, samples 1d and 1f were inferior to sample 1a, the conventional example, while samples 1b, 1c and 1f were superior to sample 1a. As the reason for the inferior discharge stability evaluation obtained for samples 1d and 1f, it is assumed that since the interval dhh, between the heat generating elements arranged along each ink flow path, or the interval dhn, between the heat generating elements and the partition walls, was comparatively large, stagnated ink portions were produced in these gaps along the ink flow paths, and a residual bubble were retained that destabilized the discharge operation.

To obtain preferable discharge stability, from these results it was determined that the interval dhn, between a partition wall 3*a* and the end of a heat generating element 2 adjacent to the partition wall 3*a*, should be 4 μm or less, and that the interval dhh, between two heat generating elements 2, should be twice the interval dhn or less.

For sample 1g, the size of the heat generating element 2, the size of the opening for the discharge port 4 and the height of the ink flow path 5 (the height of the partition wall 3*a*) are greater than those for samples 1b to 1f, so that 5 pl is set as the volume of one droplet to be discharged. As is shown in the evaluation results in Table 1, compared with the conventional sample 1a, there was little deterioration of the response frequency with the configuration for sample 1g, for which a comparatively large droplet was discharged, and a satisfactory discharge stability was obtained. From this result, it has been determined that the ink jet head of this embodiment can also be appropriately applied for a configuration for discharging a comparatively large droplet.

For samples 1h and 1i, the size of the heat generating element 2, the size of the opening for the discharge port and the height of the ink flow path (the height of a partition wall 3*a*) are smaller than those for samples 1b to 1f, so that 1 pl is set as the volume for the discharge of one droplet.

For sample 1h, as well as for samples 1b to 1f, 42 μm (600 dpi) is employed as the pitch used for both an ink flow path 5 and a discharge port 4, and 32 μm is employed as the width of an ink flow path 5. Therefore, relative to the height of an ink flow path 5, the ratio (don/H) of the distance don, between a partition wall 3*a* and the edge of a discharge port 4, is comparatively high, 1.2. Whereas for sample 1i, 28 μm (900 dpi) is employed as the pitch used for both an ink flow path 5 and a discharge port 4, and 21 μm is employed as the width of the ink flow path 5, so that the ratio don/H is 0.65, which is about the same as for samples 1b to 1f.

As is shown in the evaluation results, the response frequency and the discharge stability for samples 1h and 1i are satisfactory, especially for sample 1h, and since the diameter of a discharge port 4 is small, i.e., 8 μm, the distance don between the side face of a partition wall and the edge of a discharge port 4 is large, i.e., 12 μm, while the height of an ink flow path 5 is small, i.e., 10 μm. Therefore, in spite of being a configuration wherein the corner portions formed by the ceiling wall 3*b* and partition walls 3*a* are comparatively expanded and stagnated ink portions tend to occur, satisfactory discharge stability can be obtained. For this reason, as is shown in FIGS. 1A and 1B, a bubble generated by two heat generating elements 2 tend to impel ink in a stagnated ink portion, and it is assumed that the retention of residual bubble in the stagnated ink portion can be avoided.

Whether residual bubbles tend to be retained depends mainly on the shape (don/H) of the flow path formation members 3. In addition, the movement of the bubble generated by heat generating elements 2 also affects this phenomenon. Specifically, in the configuration wherein a bubble communicates with the outer air through a discharge port 4, air enters from the outside through the discharge port 4 once the bubble contacts the outer air, and this will produce residual bubble(s). Especially in a configuration disclosed in Japanese Patent Application Laid-Open No. 11-188870, wherein the maximum volume of a bubble has been reached and it communicates with the outer air, the size of the bubble that contacts the outer air is so great that the bubble easily reaches a position near the stagnated ink portion. Then, when this bubble is broken up and becomes residual bubble (s), stagnation of this bubble tends to occur. Even with this configuration, however, the arrangement of this invention can effectively suppress the retention of residual bubbles.

As is described above, when the interval dhn between a partition wall 3*a* and the end of a heat generating element 2 adjacent to the partition wall 3*a* is 4 μm or smaller and the ratio (partition height/width ratio) is set at from 1 to 1.5, both satisfactory response frequency and satisfactory discharge stability can be obtained, even when a tiny ink droplet of 1 pl to 5 pl is discharged.

The "resistance ratio" in the heat generating element entry in Table 1 will now be described. The resistance ratio represents the ratio (l/w) of the length l of a heat generating element 2 to the width w. For sample 1a, wherein one heat generating element is provided along each ink flow path 5, since the length l is 23 μm and the width w is 23 μm, the l/w ratio is 1.0. Whereas, for samples 1b to 1i, wherein two heat generating elements 2, which are connected in series, are provided along each ink flow path 5, the overall l/w ratio for the two heat generating elements 2 is twice the l/w ratio of each heat generating element 2. For example, for sample 1b, the l/w ratio of each heat generating element 2 is 24/11 (about 2.2), and the whole l/w ratio is double that, about 4.4.

In this embodiment, since as is shown in FIGS. 1A and 1B two heat generating elements 2 having elongated shapes are electrically connected in series, a resistance of 3.5 to 6 times that provided by a comparatively large single heat generating element is obtained, and a required current value is reduced to about ½ the conventional value. Therefore, even when the discharge operation speed is to be increased in accordance with a reduction in the size of a droplet that is to be discharged, an increase in the current flowing across the heat generating element 2 can be suppressed. In addition, heat generation and a voltage drop, due to the resistance along the wire line extending to the heat generating element 2, and the induction noise generated when a large current is fed through the wiring portion can be suppressed.

An explanation has been given for an example wherein two heat generating elements are provided in each ink flow path 5; however, the same effects as are described above can be obtained when more than two heat generating elements are provided for a single ink flow path 5. In this case, the interval dhh is defined as "an interval between the two heat generating elements that are located farthest from each other between the partition walls that define an ink flow path".

In order to increase the discharge operating speed in correspondence with a reduction in the size of a droplet to be discharged, in response to a request that an increase in the current be suppressed, or as a reflection of the view that the heat generating elements must be protected from damage occasioned by the cavitation destruction that occurs when bubble generated by boiling burst under internal negative pressure, it has been proposed that the heat generating elements be separately arranged. However, for this embodiment, the optimal positional relationships of the heat generating elements 2, the ink flow paths 5 and the discharge ports 4 have been discussed from the viewpoint of how the multiple heat generating elements 2, i.e., the multiple pressure generation sources, provided in one ink flow path 5 affect the ink discharge function. This example was not proposed in the past.

Second Embodiment

Figure 2A:
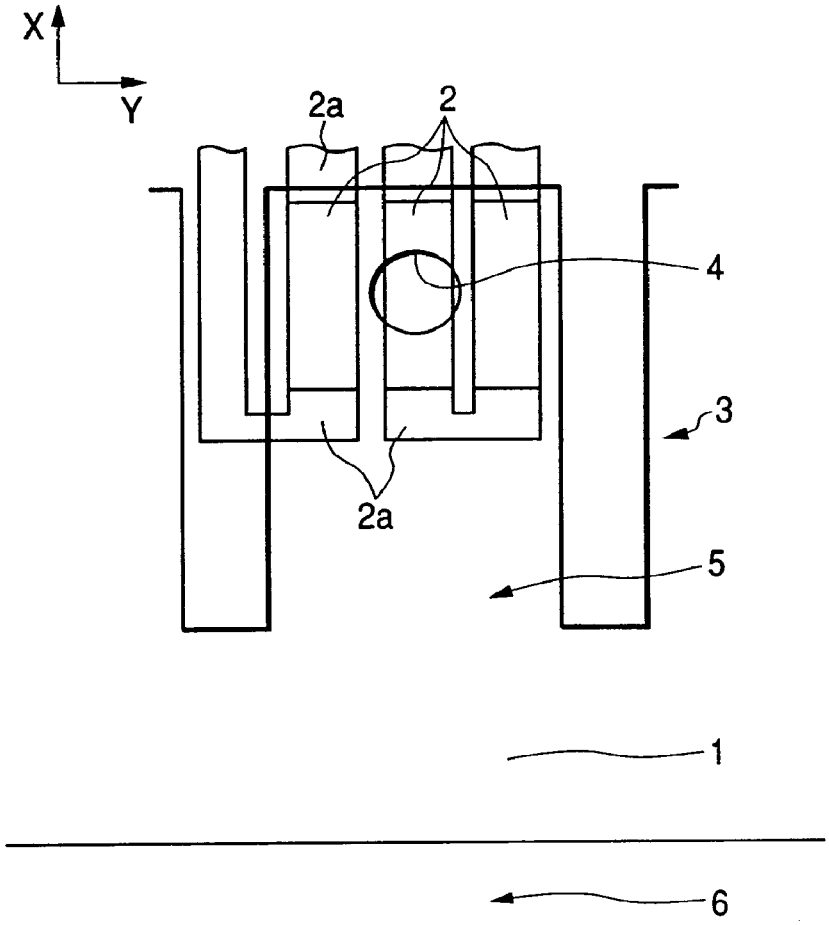
FIGS. 2A and 2B are a plan view and a cross-sectional view for explaining the positional relationship of an ink flow path, heat generating elements and a discharge port for an ink jet head according to a second embodiment of the present invention.
Figure 2B:
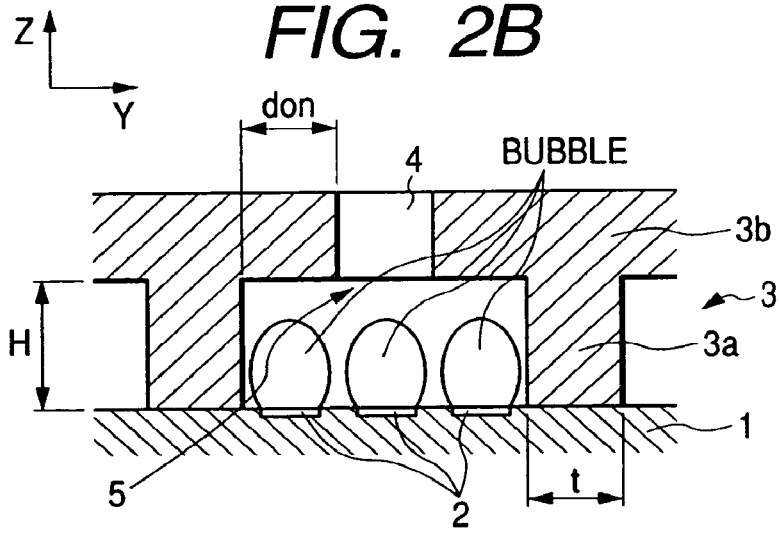

FIGS. 2A and 2B are a plan view and a cross-sectional view of the positional relationship of ink flow paths, heat generating elements and discharge ports for an ink jet head according to a second embodiment of the present invention.

As is shown in FIGS. 2A and 2B, for the ink jet head of this embodiment, three heat generating elements 2 are arranged in parallel in each flow path 5, between opposed partition walls 3*a* that define the ink flow path 5, and are electrically connected, in series, by wiring lines 2*a*. For each ink flow path 5, a discharge port 4 is formed in a ceiling 3*b* along a line extending from the center of a pressure generation region, formed by three heat generating elements 2, in the normal direction of the surface of the substrate 1.

Table 2 shows the sizes of the individual sections of a sample 2a, for the ink jet head of this embodiment, and the response frequency and discharge stability evaluation results obtained therewith.

TABLE 2

| | Head Size | | | | | | | | | | | | | | |
|---|---|---|---|---|---|---|---|---|---|---|---|---|---|---|---|
| | Heat Generating Element | | | | | | Ink Flow Path | | | | | | | Evaluation Results | |
| | Length | Width | Dimension | Resist- | | | | Flow Path | Flow Path | Partition Wall | Discharge | | | | |
| Sam-ple | l μm | W μm | S $\mu m^2$ | ance Ratio | dhh μm | dhn μm | Pitch μm | Width μm | Height μm | Height/Width Ratio | Port μm | don/H | Vd pl | f kHz | Discharge Stability |
| 2a | 22 | 8 | 528 | 8.3 | 2 | 2 | 42 | 32 | 13 | 1.3 | 10.5 | 0.83 | 2.5 | 55 | A |

As is shown in Table 2, for the ink jet head of this embodiment as well as the first embodiment, preferable results can be obtained for the response frequency and the discharge stability. Especially, in this embodiment, since three heat generating elements 2 are provided in one ink flow path 5, the l/w ratio of each heat generating element 2 is increased, and accordingly, the overall resistance ratio for the heat generating elements is increased and is about eight times that of the conventional ratio. Therefore, the value of the current flowing across the heat generating element 2 can be reduced, and a greater suppression effect can be obtained for limiting heat generation and voltage drop, due to resistance at the wiring line extending to the heat generating elements 2, and the induction noise that is produced when a large current flows along the wiring line.

In this embodiment, three heat generating elements 2 have been arranged in one ink flow path 5. However, more than three heat generating elements 2 may be so provided, and by thus increasing the number of heat generation elements 2, and even greater resistance ratio can be obtained.

Third Embodiment

Figure 3A:
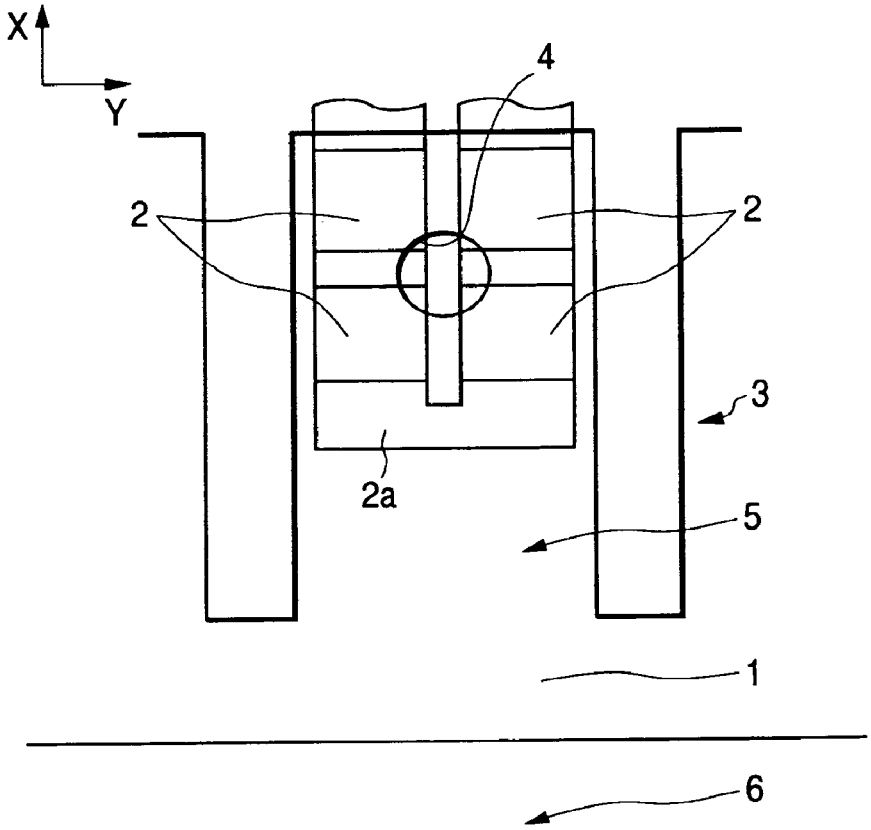
FIGS. 3A and 3B are a plan view and a cross-sectional view for explaining the positional relationship of an ink flow path, heat generating elements and a discharge port for an ink jet head according to a third embodiment of the present invention.
Figure 3B:
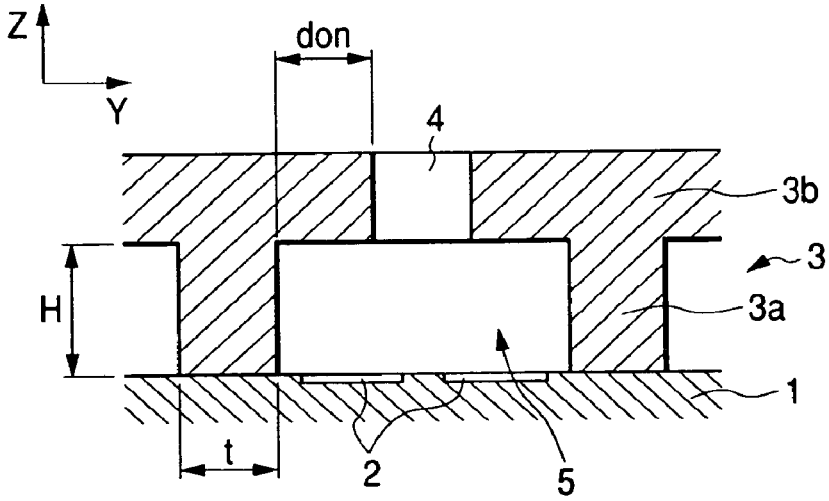

FIGS. 3A and 3B are a plan view and a cross-sectional view of the positional relationships of ink flow paths, heat generating elements and a discharge port for an ink jet head according to a third embodiment of the present invention.

Especially, as is shown in FIG. 3A, for the ink jet head of this embodiment, a set of four heat generating elements 2 are provided in one ink flow path 5. Of these heat generating elements 2, two are arranged in the X direction and the other two are arranged in the Y direction, where the X direction denotes the direction in which ink flows along the ink flow path 5, and the Y direction denotes the direction perpendicular to the X direction and parallel to the surface of a substrate 1, i.e., the direction across those partition walls 3*a* that define an ink flow path 5. Further, these heat generating elements 2 are electrically connected, in series, by wiring lines, and a discharge port 4 is formed along a line extending from the center of a pressure generation region, formed by the four heat generating elements 2, in the normal direction of the surface of the substrate 1.

Table 3 shows the sizes of the individual sections of a sample 3a, for the ink jet head of this embodiment, and the response frequency and discharge stability evaluation results obtained therewith.

TABLE 3

| | Head Size | | | | | | | | | | | | | | |
|---|---|---|---|---|---|---|---|---|---|---|---|---|---|---|---|
| | Heat Generating Element | | | | | | Ink Flow Path | | | | | | | Evaluation Results | |
| | Length | Width | Dimension | Resist- | | | | Flow Path | Flow Path | Partition Wall | Discharge | | | | |
| Sam-ple | l μm | W μm | S $\mu m^2$ | ance Ratio | dhh μm | dhn μm | Pitch μm | Width μm | Height μm | Height/Width Ratio | Port μm | don/H | Vd pl | f kHz | Discharge Stability |
| 3a | 6 | 12 | 276 | 2.1 | 3 | 3 | 42 | 32 | 10 | 1.0 | 8 | 1.2 | 1 | 75 | A |

As is shown in the evaluation results column in Table 3, for the ink jet head for this embodiment also, preferable results can be obtained for the response frequency and the discharge stability.

Figure 4A:
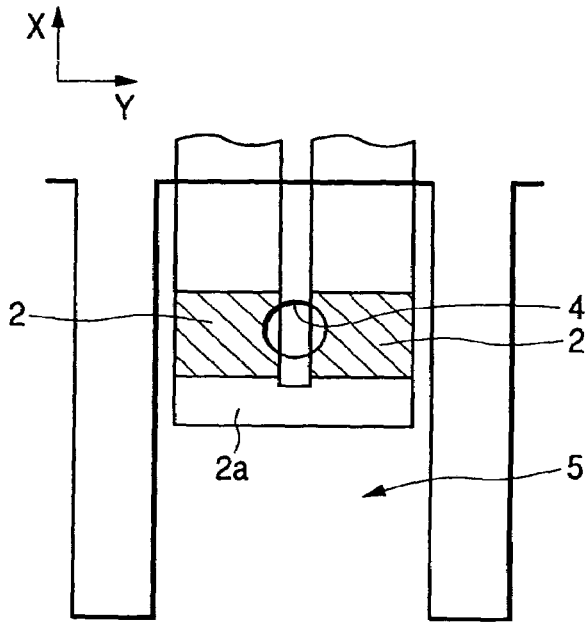
FIGS. 4A and 4B are diagrams for explaining the advantage provided by the ink jet head according to the third embodiment of the present invention.
Figure 4B:
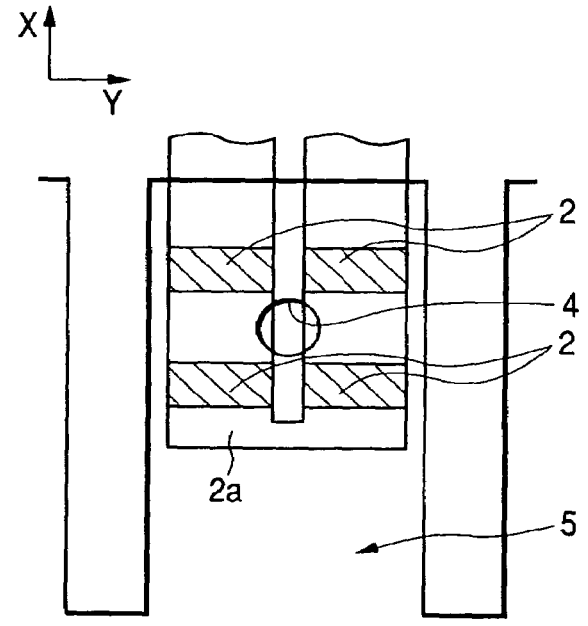

FIG. 4A is a perspective plan view of the positional relationships of ink flow paths, heat generating elements and a discharge port for sample 1h, as shown in Table 1. FIG. 4B is a perspective plan view of the positional relationships of ink flow paths, heat generating elements and a discharge port when the total of the dimensions for the heat generating elements is the same as that for sample 1h, while four heat generating elements are separately provided.

As is shown in FIG. 4A, assume that the ink flow path 5 is wide relative to the total of the dimensions of the heat generating elements 2, and that the overall shape formed by the two heat generating elements 2 is not square but is rather rectangular. In this case, when the center of the discharge port 4 is shifted in the Y direction, for example, away from the center of the pressure generation region formed by the two heat generating elements 2, the direction in which liquid droplets are discharged would be greatly biased by one of the heat generating elements 2. Therefore, the direction in which the droplets are to be discharged would become destabilized.

However, for the configuration according to the embodiment in FIG. 4B, an arrangement that is square in appearance is formed by the four heat generating elements 2, and since the discharge port 4 is centrally located relative to the square, for the discharge port 4, the symmetry in the pressure generation region is improved. Thus, even when the center of the discharge port 4 is shifted in either direction X or Y, biasing in the direction in which liquid droplets are discharged, which would be caused by a specific heat generating element 2, is offset by biasing in the direction in which liquid droplets are discharged, which would be caused by the other heat generating elements 2. As a result, the direction in which the droplets are discharged can be stabilized.

Fourth Embodiment

Figure 5:
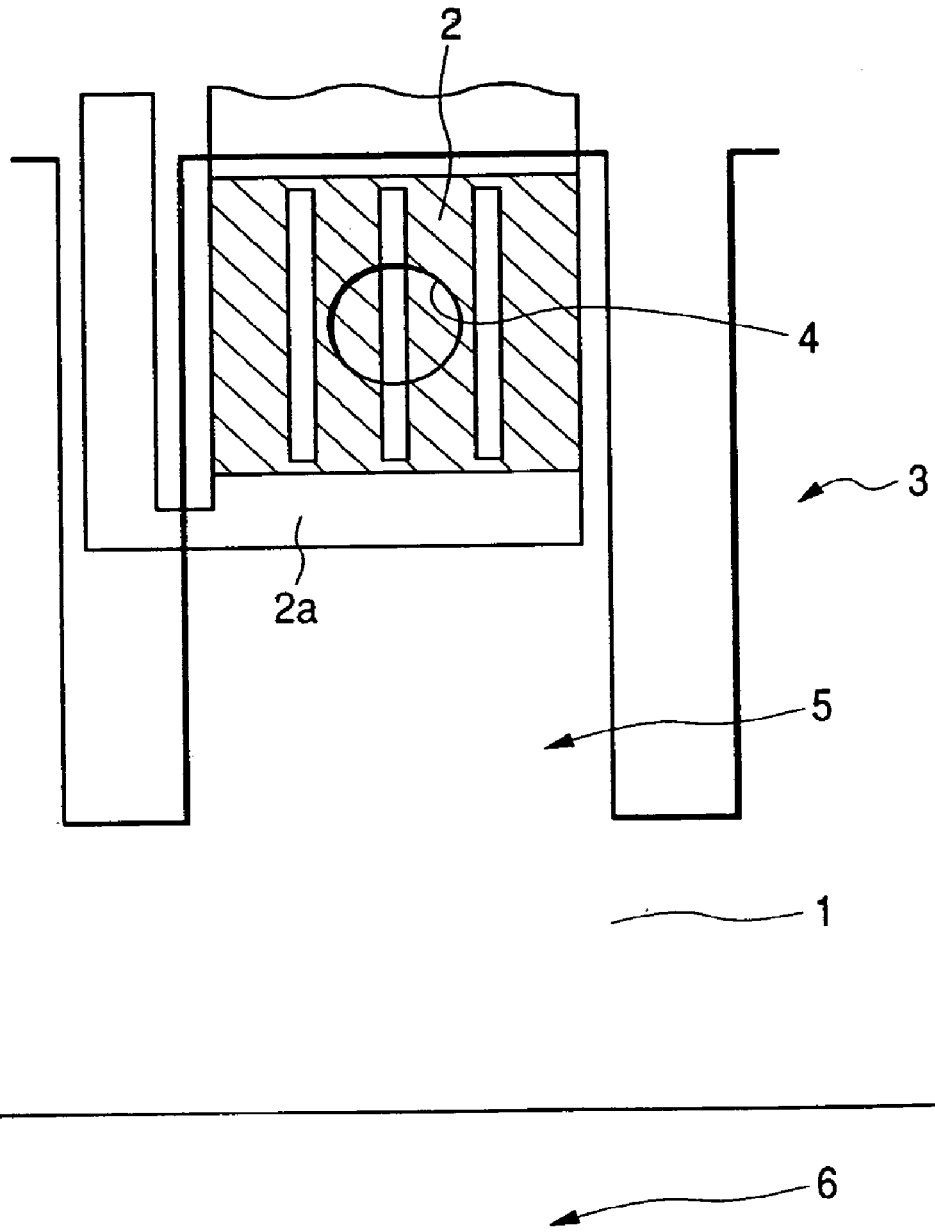
FIG. 5 is a perspective plan view for explaining the positional relationship of an ink flow path, heat generating elements and a discharge port for an ink jet head according to a fourth embodiment of the present invention.

FIG. 5 is a perspective plan view of the positional relationships of an ink flow path, a heat generating element and a discharge port for an ink jet head according to a fourth embodiment of the present invention.

In this embodiment, multiple slits are formed in a comparatively large heat generating element 2, so that substantially, an arrangement consisting of multiple elongated heat generating elements is obtained. Since in order to increase a resistance value, the thickness of the heat generating element 2 is equal to or less than 1/10 the thickness of a wiring line 2*a*, the long slits shown in FIG. 5 can be easily formed in the heat generating element 2.

With the configuration wherein multiple slits are formed in the comparatively large heat generating element 2, when the sizes or the number of the slits to be formed is changed, the actual number and shapes of the heat generating elements can be easily changed as desired.

Fifth Embodiment

Figure 6A:
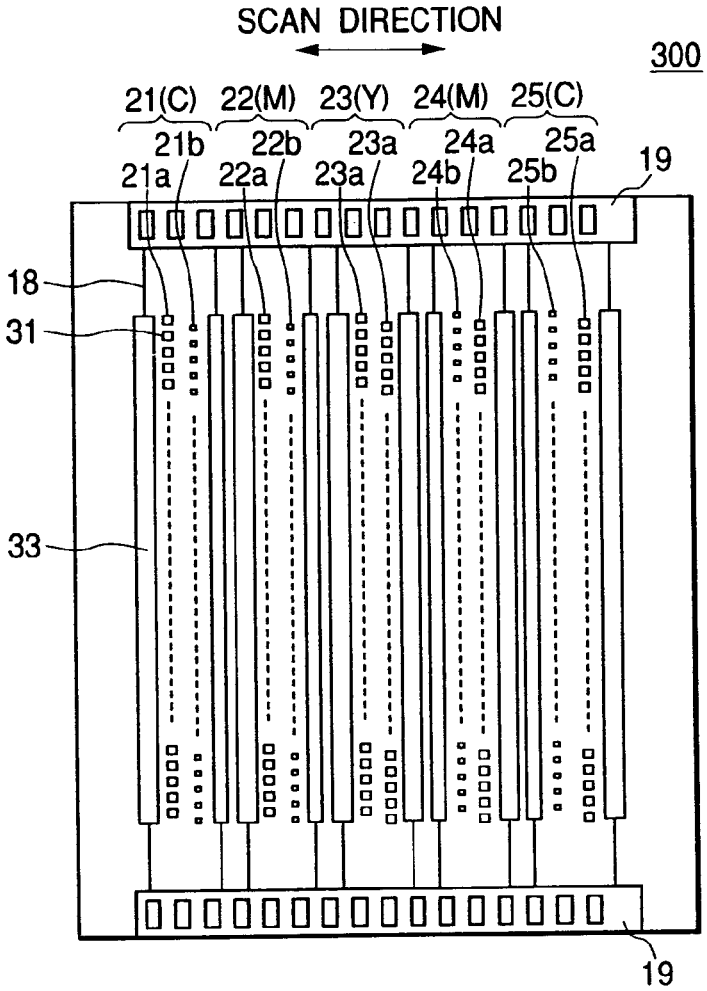
FIG. 6A is a plan view of an essential portion of an ink jet head according to a fifth embodiment of the present invention.
Figure 6B:
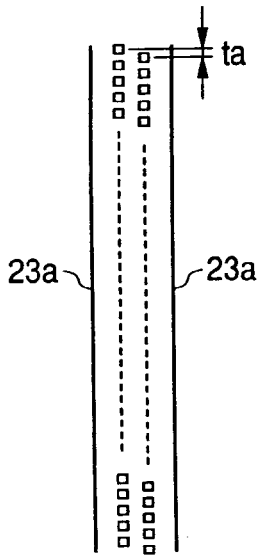
FIG. 6B is a diagram for explaining the arrangement of discharge ports.
Figure 6C:
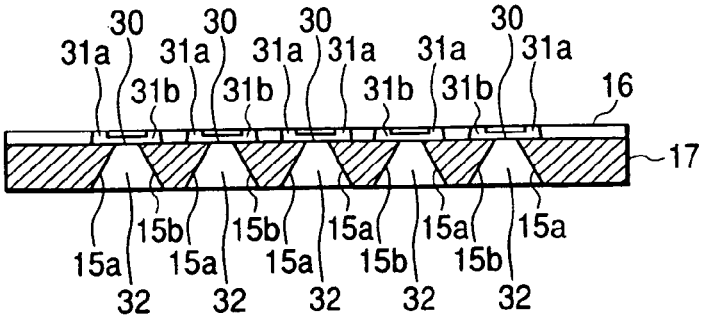
FIG. 6C is a cross-sectional view of the essential portion of the ink jet head.

FIG. 6A is a specific plan view of an essential portion of an ink jet head according to a fifth embodiment of the present invention, while FIG. 6B is a diagram for explaining the arrangement of discharge port arrays and FIG. 6C is a cross-sectional view of the essential portion of the ink jet head.

As is shown in FIG. 6C, a recording head 300 for this embodiment comprises: a substrate 17, including heat generating resistors 15*a* and 15*b* as energy converting elements; and an orifice plate 16, for the formation of discharge ports 31 (31*a* and 31*b*) and ink flow paths 30 along which ink is supplied to the discharge ports 31.

In this embodiment, the substrate 17 is made of monocrystalline silicon of surface bearing (100), and on the top face (the face connected to the orifice plate 6), the heat generating resistors 15*a* and 15*b*, a driving circuit 33, such as a driving transistor for driving the heat generating resistors 15*a* and 15*b*, a contact pad 19, to be connected to a wiring plate that will be described later, and a wiring line 18, for connecting the driving circuit 33 to the contact pad 29, are formed by performing a semiconductor process. Furthermore, five through holes are formed by anisotropic etching in an area of the substrate 17 other than that occupied by the driving circuit 33, the heat generating resistors 15*a* and 15*b*, the wiring line 18 and the contact pad 19. In these through holes, ink supply ports 32 are formed to supply ink to supply discharge port arrays 21*a*, 21*b*, 22*a*, 22*b*, 23*a*, 23*a*, 24*a*, 24*b*, 25*a* and 25*b*. In FIG. 6A, the state wherein the substantially transparent orifice plate 16 is mounted on the substrate 17 is specifically shown, while the ink supply ports 32 are not depicted.

Of the discharge port arrays 21, 21*b*, 22*a*, 22*b*, 23*a*, 23*a*, 24*a*, 24*b*, 25*a* and 25*b*, those that communicate with the same ink supply ports 32 are paired to provide five discharge port array pairs 21, 22, 23, 24 and 25. Cyan (C) ink is supplied to the discharge port array pairs 21 and 25, magenta (M) ink is supplied to the discharge port array pairs 22 and 24, and yellow (Y) ink is supplied to the discharge port array pair 23. In each of the discharge port array pairs, the two discharge port arrays (which are adjacent to each other) are shifted with respect to each other by a distance ta in the arrangement direction, as is depicted in FIG. 6B for the discharge port pair 23.

The orifice plate 16 provided on the substrate 17 is formed of a photosensitive epoxy resin, and in a process disclosed in Japanese Patent Application Laid-Open No. 62-264957, for example, the discharge ports 31 and the liquid flow paths 30 are formed so as to correspond to the heat generating resistors 15*a* and 15*b*. At this time, as is disclosed in Japanese Patent Application Laid-Open No. 9-11479, in order to fabricate an inexpensive, precise recording head, preferably, a silicon oxide film or a silicon nitride film (not shown) is deposited on the silicon substrate 17, the orifice plate 16 including the discharge ports 31 and the liquid flow paths 30 is formed, and thereafter, the silicon oxide film or the silicon nitride film is removed, by anisotropic etching, from the portions used as the ink supply ports 32.

Figure 7A:
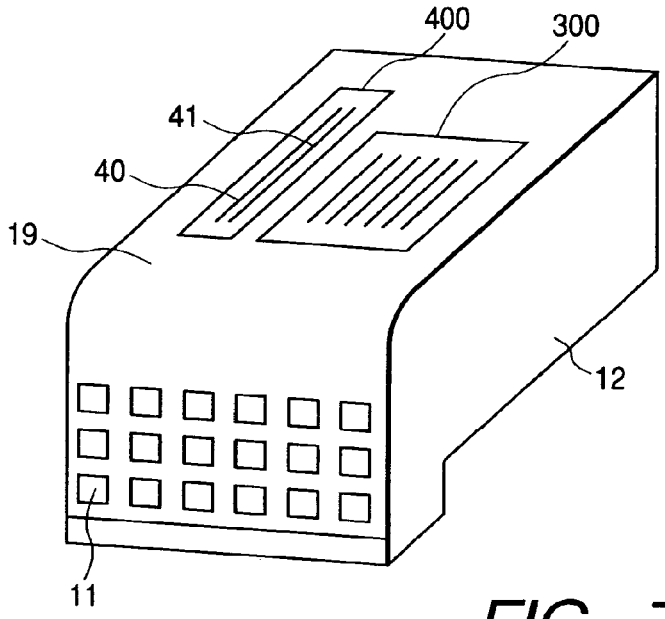
FIGS. 7A, 7B and 7C are diagrams showing an example ink jet recording cartridge, including the ink jet head shown in FIGS. 6A, 6B and 6C.
Figure 7B:
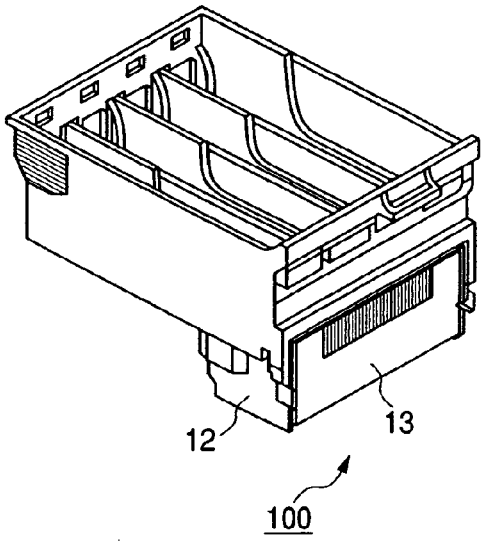
Figure 7C:
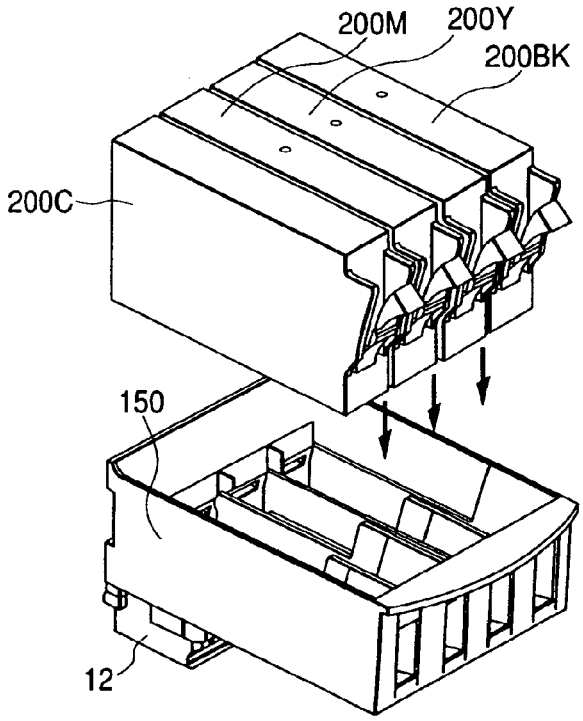

FIGS. 7A to 7C are diagrams showing an example ink jet cartridge that includes the ink jet head in FIGS. 6A to 6C.

The recording head 300, which includes the substrate 17 and the orifice plate 16, employs the pressure produced by bubbles, which are generated by film boiling using thermal energy applied by the heat generating resistors 15*a* and 15*b*, to record data by discharging a liquid, such as ink, through the discharge ports 31. As is shown in FIG. 7A, the recording head 300 is fixed to an ink flow path forming member 12 that supplies ink to the ink supply ports 32, and the contact pad 19 is connected to the wiring plate 13. When an electric connector 11 provided for the wiring plate 13 is connected to the electric connector of a recording apparatus, which will be described later, a drive signal can be received from the recording apparatus.

In addition to the recording head 300 that can discharge Y, M and C ink, a recording head 400 that includes discharge port arrays 40 and 41 for discharging black ink (Bk) is also fixed to the ink flow path forming member 12. These components are assembled to form a recording head cartridge 100 that can discharge four colors of ink.

FIGS. 7B and 7C are perspective views of the recording head cartridge 100, including the recording head 300. As is shown in FIG. 7C, the recording head cartridge 100 includes a tank holder 150 in which ink tanks 200Y, 200M, 200C and 200Bk are held that supply ink to the ink flow path forming member 12.

While referring again to FIGS. 6A to 6C, in this embodiment, ten discharge port arrays are formed in the single substrate 17 of the recording head 300, while five slit ink supply ports 32 are formed in the substrate 17. The discharge port arrays for each discharge port array pair are arranged on either side in the longitudinal direction of the ink supply ports 32.

When ink from the ink tanks 200Y to 200Bk is supplied to the ink supply ports 32 through the ink flow path forming member 12, the ink is fed from the reverse face of the substrate 17 to the obverse face, and is transmitted to the discharge ports 31 along the ink flow paths 30 formed in the surface of the substrate 17. The ink is then discharged from the discharge ports 31 by the pressure produced by bubble generated by boiling using the heat generating resistors 15*a* and 15*b*, which are provided near the individual discharge ports 31 on the surface of the substrate 17.

As is described above, beginning from the left in FIG. 6A, cyan (C), magenta (M), yellow (Y), magenta (M) and cyan (C) ink are supplied in order to the ink supply ports 32. Therefore, cyan ink is discharged from the four discharge port arrays 21*a*, 21*b*, 25*a* and 25*b*; magenta ink is discharged from the four discharge port arrays 22*a*, 22*b*, 24*a* and 24*b*; and yellow ink is discharged from the two discharge port arrays 23*a*, 23*a*. When the recording head 300 is being moved in the scan direction indicated by an arrow head pointing to the left in FIG. 6A, ink is discharged from the discharge port arrays 21, 22 and 23 to perform recording, and when the recording head 300 is being moved in the scan direction indicated by an arrow head pointing to the right, ink is discharged from the discharge port arrays 25, 24 and 23 to perform recording. With the arrangement whereby individual colors of ink are supplied to the discharge port arrays, when to perform recording the recording head 300 is moved in either direction indicated by the double-headed arrow in FIG. 6A (bidirectional recording), as the recording head 300 moves forward and backward, ink colors are superimposed in the same order on the recording medium. Thus, a high quality image having no uneven colors can be quickly recorded.

For the recording head 300 in this embodiment, the discharge port pairs 21 and 25 for discharging cyan ink and the discharge port arrays 22 and 24 for discharging magenta ink are each formed of two discharge port arrays, which include discharge ports from which liquid droplets of different sizes are discharged. That is, the discharge port array 21 or 25 for discharging cyan ink is formed of a discharge port array 21*a* or 25*a* consisting of discharge ports for discharging comparatively large liquid droplets, and a discharge port array 21*b* or 25*b* is formed of discharge ports for discharging comparatively small liquid droplets. The discharge port array 22 or 24 for discharging magenta ink is formed of a discharge port array 22*a* or 24*a* consisting of discharge ports for discharging comparatively large liquid droplets, and a discharge port array 22*b* or 24*b* for discharging comparatively small liquid droplets.

In accordance with these arrays, a comparatively large heat generating resistor 15*a* is provided in the discharge ports of the discharge port arrays 21*a*, 22*a*, 24*a* and 25*a* for discharging comparatively large liquid droplets, and a comparatively small heat generating resistor 15*b* is provided in the discharge ports of the discharge port arrays 21*b*, 22*b*, 24*b* and 25*b* for discharging comparatively small liquid droplets.

With this configuration, the discharge ports used for recording are employed depending on the requirement, e.g., the discharge port 31*b* for discharging a comparatively small liquid droplet is employed for a portion for which high-resolution image recording is required, and the discharge port 31*a* for discharging a comparatively large liquid droplet is employed for other portions. Therefore, while maintaining a high recording speed, high quality recording can be performed. In order to most satisfactorily establish the high quality and the high speed, it is preferable that a ratio of 2:1 or higher be set as the ratio of the volume (size) of a liquid droplet discharged from the discharge port arrays 21*a*, 22*a*, 24*a* and 25*a*, which discharge comparatively large liquid droplets, relative to the volume (size) of a liquid droplet discharged from the discharge port arrays 21*b*, 22*b*, 24*b* and 25*b*, which discharge comparatively small liquid droplets. Further, it is preferable that the ratio of 2:1 or higher be set as the ratio for the opening size of the discharge port 31*a*, for discharging a comparatively large liquid droplet, to the opening size of the discharge port 31*b*, for discharging a comparatively small liquid droplet.

The discharge port array 23 for discharging yellow ink is formed of two discharge port arrays 23*a*, each of which includes discharge ports for discharging a comparatively large liquid droplet. The comparatively large heat generating element 15*a*, which is the same as that used for the discharge port arrays 21*a*, 22*a*, 24*a* and 25*a*, is provided in the discharge ports of the discharge port arrays 23*a*.

At this time, preferably, the volume of ink filling the area in the ink flow path 30 that is immediately below the discharge port 31*b* for discharging a comparatively small liquid droplet, should be reduced. That is, it is preferable that the size of the discharge port 31*b* be reduced and the height of the ink flow path 30 formed in the orifice plate 16 be lowered. However, since with this configuration the stagnated ink portion (as shown in FIGS. 9A and 9B) is increased, deterioration of the discharge function due to residual bubble tends to occur.

As for the discharge port 31*a* for discharging a comparatively large liquid droplet, because of the manufacturing process employed when forming the ink flow path 30 in the orifice plate 16, the height of the ink flow path 30 is the same as the height set for the discharge port 31*b* for discharging a comparatively small liquid droplet. Therefore, for the discharge port 31*a* for discharging a comparatively large liquid droplet, since the height of the ink flow path 30 is less than is appropriate, and the size in cross section of the path is reduced, the flow path resistance is increased, and accordingly, the response frequency is reduced.

For the ink jet head of this embodiment, therefore, two heat generating resistors are provided along each ink flow path, as in the configuration in FIGS. 1A and 1B, and the sizes of the individual sections are set as is shown in Table 4.

TABLE 4

| | Head Size | | | | | | | | | | | | | | |
|---|---|---|---|---|---|---|---|---|---|---|---|---|---|---|---|
| | | | | | | | | Ink Flow Path | | | | | | | |
| | Heat Generating Element | | | | | | | Flow Path | Flow Path | Partition Wall | Discharge | | | Evaluation Results | |
| | Length l μm | Width W μm | Dimension S μm$^2$ | Resistance Ratio | dhh μm | dhn μm | Pitch μm | Width μm | Height μm | Height/Width Ratio | Port μm | don/H | Vd pl | f kHz | Discharge Stability |
| Small Liquid Droplet | 22 | 13 | 550 | 3.5 | 3 | 2 | 42 | 32 | 13 | 1.3 | 10.5 | 0.83 | 2.5 | 55 | A |
| Large | 28 | 13 | 700 | 4.5 | 3 | 2 | 42 | 32 | 13 | 1.3 | 16 | 0.62 | 5 | 31 | A |

TABLE 4-continued

| | Head Size | | | | | | | | | | | | | | |
|---|---|---|---|---|---|---|---|---|---|---|---|---|---|---|---|
| | | | | | | | Ink Flow Path | | | | | | | | |
| | Heat Generating Element | | | | | | | Flow | Flow | Partition | | | | Evaluation | |
| | Length | Width | Dimen- | Resist- | | | | Path | Path | Wall | Discharge | | | Results | |
| | l μm | W μm | sion S $\mu m^2$ | ance Ratio | dhh μm | dhn μm | Pitch μm | Width μm | Height μm | Height/Width Ratio | Port μm | don/H | Vd pl | f kHz | Discharge Stability |
| Liquid Droplet | | | | | | | | | | | | | | | |

As a result, for the discharge port 31*a* for discharging a comparatively large liquid droplet, appropriate discharge stability is obtained while a satisfactory response frequency is maintained. For the discharge port 31*b* for discharging a comparatively small liquid droplet, both the response frequency and the discharge stability are appropriate.

The optimal configuration for this embodiment has been explained. However, the ink type supplied by each of the ink supply ports 32, the number of the ink supply ports 32 and the number of discharge arrays are not limited to those used for the configuration, and can be changed as needed.

OTHER EMBODIMENT

Figure 8:
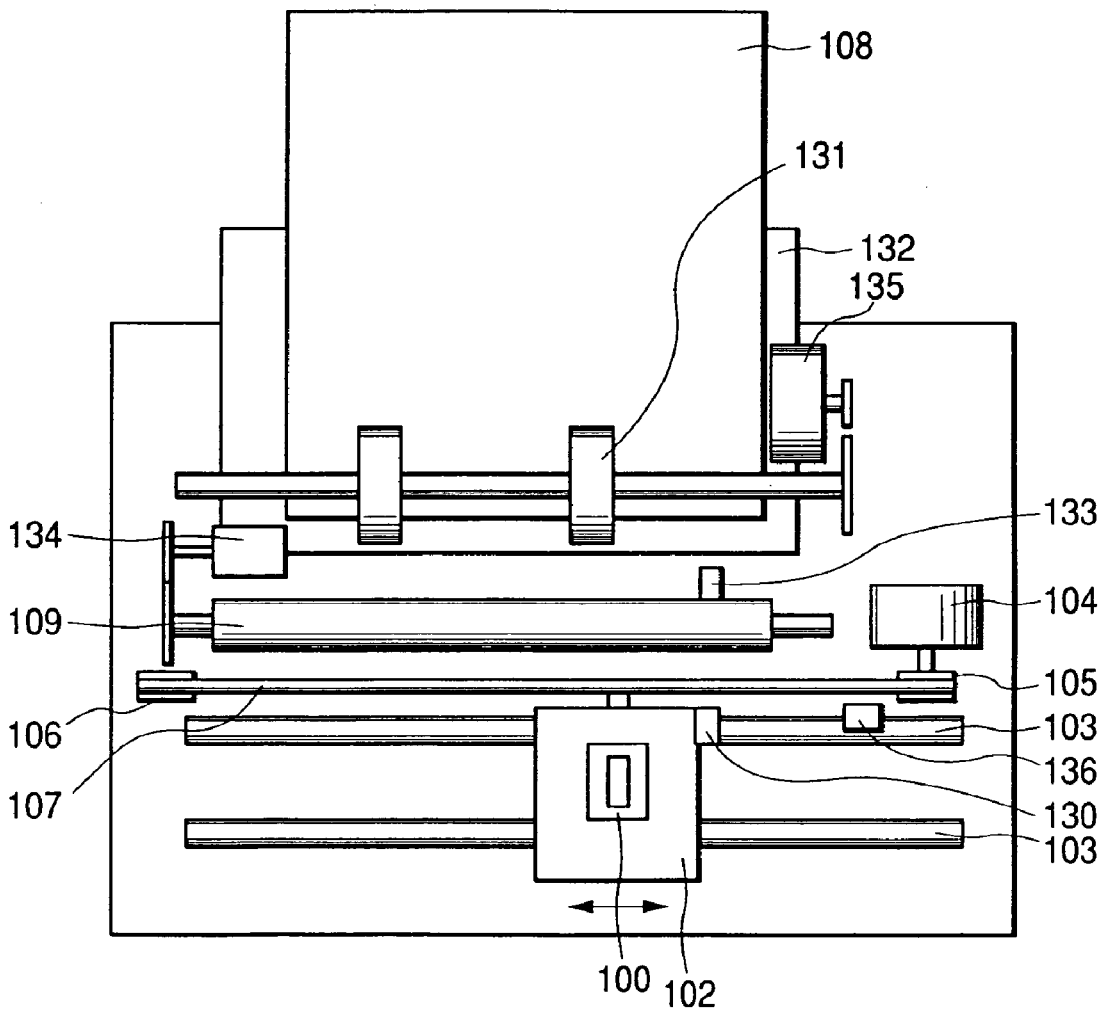
FIG. 8 is a schematic diagram showing the configuration of an example recording apparatus on which the ink jet head according to the present invention can be mounted.

Finally, while referring to FIG. 8, an explanation will be given for a recording apparatus wherein the ink jet head or the recording head cartridge explained for each embodiment can be mounted. FIG. 8 is a schematic diagram showing the configuration of an example recording apparatus wherein the ink jet head of the present invention can be mounted.

As is shown in FIG. 8, an exchangeable recording head cartridge 100 is mounted on a carriage 102. The recording head cartridge 100 includes a recording head unit and ink tanks, as well as a connector (not shown) for exchanging driving signals for the individual heads.

The exchangeable recording head cartridge 100 is positioned and mounted on the carriage 102, and is connected to an electric connector through which drive signals are transmitted to each head.

The carriage 102 is supported so that it can be reciprocally moved along a guide shaft 103, which is provided for the main body of the recording apparatus and is extended in the main scan direction as indicated by double-headed arrows. The carriage 102 is driven by a main scan motor 104 via driving mechanisms, such as a motor pulley 105, a driven pulley 106 and a timing belt 107, and the position and the movement of the carriage 102 are controlled. Furthermore, a home position sensor 130 is provided for the carriage 102, and when the home position sensor 130 detects the location of a shielding plate 136, it can be ascertained that the carriage 102 is located at the home position.

When a feed motor 135 is driven to rotate a pickup roller 131 via a gear, the recording media 108, such as recording sheets and thin plastic sheets, are separated one by one and are individually fed from an auto sheet feeder 132. Further, as a convey roller 109 is rotated, the recording medium 108 is conveyed (sub-scanned) through a position (printing portion) opposite the discharge port face of the head cartridge 100. When an LF motor 134 is driven, the driving force is transmitted via the gear and the convey roller 109 is rotated. At this time, a determination is made as to whether the recording medium 108 has actually been fed and whether the leading position of the recording medium 108 was established when the leading edge of the recording medium 108 passed through a paper end sensor 133 in the conveying direction. The paper end sensor 133 is also employed to detect the current position of the trailing end of the recording medium 108, and to obtain the current recording position based on the actual detection of the trailing end.

The reverse face of the recording medium 108 is supported by a platen (not shown), so that there is a flat printing face at the printing portion. In this case, the recording head cartridge 100 mounted on the carriage 102 is held so that the discharge port face projects downward, and is parallel to the recording medium 108.

The recording head cartridge 100 is mounted on the carriage 102, so that the direction in which the discharge port arrays are directed intersects the scan direction of the carriage 102. The recording of the recording medium 108 is accomplished by repeatedly performing an operation whereby ink is discharged through the ink discharge arrays while the recording head cartridge 100 is moved in the main scanning direction, and an operation whereby the conveying roller 109 conveys the recording medium 108 in the sub-scan direction a distance equivalent to the recording width of a single scan.

The invention claimed is:

1. An ink jet head for discharging ink by a pressure change caused by boiling the ink, said ink jet head comprising:

a substrate provided with, in an array arrangement, a plurality of heat generating elements for generating the pressure change; and a plurality of ink flow paths, which respectively communicate with discharge ports, for supplying the ink, wherein said ink flow paths have a ceiling provided with the discharge ports and a plurality of partition walls contacting said substrate and said ceiling to form bent portions, wherein between each pair of wall surfaces constituting said ink flow paths, two or more of said plurality of heat generating elements are provided in a direction in which said wall surfaces are opposed to each other, and wherein in each ink flow path, in a direction in which said two or more heat generating elements are arranged, an interval between each of the partition walls and the heat generating element adjacent to the respective partition wall is equal to or less than 4 μm.

2. An ink jet head according to claim 1, wherein, for each partition wall used to define the ink flow paths, the ratio H/t is from 1 to 1.5, where H is the distance between said surface of said substrate and said ceiling and t is the thickness of the partition wall.

3. An ink jet head according to claim 1, wherein the width of each of the ink flow paths between the partition walls is constant for the entire area wherein the ink flows along the ink flow paths toward the heat generating elements.

4. An ink jet head according to claim 2, wherein said plurality of discharge ports include discharge ports of multiple types, for which liquid droplets to be discharged differ in size.

5. An ink jet head according to claim 4, wherein, of the liquid droplets having different sizes, the largest liquid droplet is at least twice the size of the smallest liquid droplet.

6. An ink jet head according to claim 4, wherein the discharge ports of multiple types include discharge ports having discharge port openings of different sizes and the size of the discharge port opening from which the largest liquid droplet is discharged is at least twice the size of the discharge port opening for discharging the smallest liquid droplet.

7. An ink jet head according to claim 4, wherein the distance H is equal for all the ink flow paths, regardless of the sizes of the liquid droplets discharged from the discharge ports.

8. An ink jet head according to claim 1, wherein, for each ink flow path, at least two heat generating elements provided therein are arranged with a specific interval dhh therebetween, between the partition walls of the ink flow path, and the specific interval dhh is provided between two adjacent heat generating elements that are located farthest from each other between the partition walls of the ink flow path, and the specific interval dhh is less than or equal to twice the interval between each partition wall of the ink flow path and the heat generating element adjacent thereto.

9. An ink jet head according to claim 1, wherein three or more of said heat generating elements are arranged in each of said ink flow paths in a direction perpendicular to the partition walls.

10. An ink jet head according to claim 2, wherein the distance H is equal to or smaller than 15 μm.

11. An ink jet head according to claim 2, wherein the ratio don/H is less than or equal to ½, where don is a distance from an edge of each of the discharge ports to the partition wall adjacent thereto in a direction perpendicular to the partition walls.

12. An ink jet head according to claim 1, further comprising a flow path forming member made of a photosensitive epoxy resin.

13. An ink jet head according to claim 1, wherein for each ink flow path the discharge port is arranged on a line extending in a direction normal to a surface of said substrate from a center of a pressure generation area containing said two or more heat generating elements in the ink flow path, and wherein an arrangement pitch of the plurality of discharge ports is not less than 600 dpi.

14. An ink jet head according to claim 1, wherein a line extending in a direction normal to a surface of said substrate from a center of gravity of each of said heat generating elements intersects said ceiling wall.

15. An ink jet head according to claim 1, wherein in each ink flow path said two or more heat generating elements are connected with a U-shaped wiring.

16. An ink jet head according to claim 1, wherein for each ink flow path an end of said ink flow path is closed with respective ones of said plurality of partition walls at a cross-section parallel to a surface in which the discharge ports are provided.

* * * * *